US012532973B1

(12) United States Patent
Zingarelli

(10) Patent No.: US 12,532,973 B1
(45) Date of Patent: Jan. 27, 2026

(54) PORTABLE SPRING MATTRESS

(71) Applicant: Frank Zingarelli, Newport, RI (US)

(72) Inventor: Frank Zingarelli, Newport, RI (US)

( * ) Notice: Subject to any disclaimer, the term of this patent is extended or adjusted under 35 U.S.C. 154(b) by 166 days.

(21) Appl. No.: 18/125,975

(22) Filed: Mar. 24, 2023

(51) Int. Cl.
*A47C 27/06* (2006.01)
*A47C 27/15* (2006.01)

(52) U.S. Cl.
CPC ..... *A47C 27/065* (2013.01); *A47C 27/15* (2013.01)

(58) Field of Classification Search
CPC ..... A47C 27/065; A47C 27/061; A47C 23/02; A47C 23/28; A47C 27/07; A47C 7/285; F16F 1/14; E05F 1/1215
See application file for complete search history.

(56) References Cited

U.S. PATENT DOCUMENTS 2,497,266 A * 2/1950 Levane ..... E05F 1/1215 16/256
2,724,842 A * 11/1955 Rogovy ..... A47C 27/061 5/248
2,945,244 A * 7/1960 Lincoln ..... A47C 31/123 5/936
3,042,395 A * 7/1962 Cole ..... A47C 27/065 267/108
5,584,100 A * 12/1996 Doyle ..... E05F 1/1215 16/300
6,739,107 B1 * 5/2004 Lewis ..... B65B 63/028 53/529
11,389,008 B2 7/2022 Nie

FOREIGN PATENT DOCUMENTS

WO WO-2019086155 A1 * 5/2019 ..... A47C 27/001

* cited by examiner

*Primary Examiner* — Matthew Troutman
*Assistant Examiner* — Alison N Labarge
(74) *Attorney, Agent, or Firm* — Sanchelima & Associates, P.A.; Jesus Sanchelima; Christian Sanchelima

(57) ABSTRACT

A portable spring mattress including a mattress assembly and a spring assembly. The mattress assembly includes a top layer and a bottom layer made of a pliable comfortable foam that is configured to support and absorb the weight of a user. Spring assembly includes a plurality of collapsible members and a plurality of torsion spring hinges, wherein the plurality of collapsible members is attached between the top layer and the bottom layer. The plurality of collapsible members include a plurality of torsion spring hinges that are actuated by means of a lever, thereby the user may actuate said lever for collapsing said plurality of collapsible members to reduce the size and fold the mattress assembly for transporting and storing. The lever may be actuated in an opposite direction to return the plurality of collapsible members to its original position to receive the user.

1 Claim, 3 Drawing Sheets

PORTABLE SPRING MATTRESS

1. FIELD OF THE INVENTION

The present invention relates to a mattress and, more particularly, to a portable spring mattress that provides support as a spring mattress and is capable of being folded when the springs are selectively collapsed, allowing it to be folded for easy transportation and/or storing.

2. DESCRIPTION OF THE RELATED ART

Several designs for portable spring mattresses have been designed in the past. None of them, however, include a mattress assembly with a plurality of selectively collapsible hinge springs that allows the mattress to provide support and to be rolled for transportation.

Applicant believes that a related reference corresponds to U.S. Pat. No. 11,389,008 issued for foldable tension spring mattress. Applicant believes that another related reference corresponds to U.S. Pat. No. 6,739,107 issued for method and apparatus for compressing a mattress with an inner coil. None of these references, however, teach of a mattress assembly with a plurality of internal hinged spring members which are used to provide support within the mattress and where the spring members can all be selectively folded into a compressed state which allows the mattress assembly to be rolled into a compact form for travel.

Other documents describing the closest subject matter provide for a number of more or less complicated features that fail to solve the problem in an efficient and economical way. None of these patents suggest the novel features of the present invention.

III. SUMMARY OF THE INVENTION

It is one of the objects of the present invention to provide a comfortable device for laying on it.

It is another object of this invention to provide a device that is capable of being extended and rolled for easy transportation or storing.

It is still another object of the present invention to provide a device that includes a spring that is selectively tensioned or collapsible.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

Figure 1:
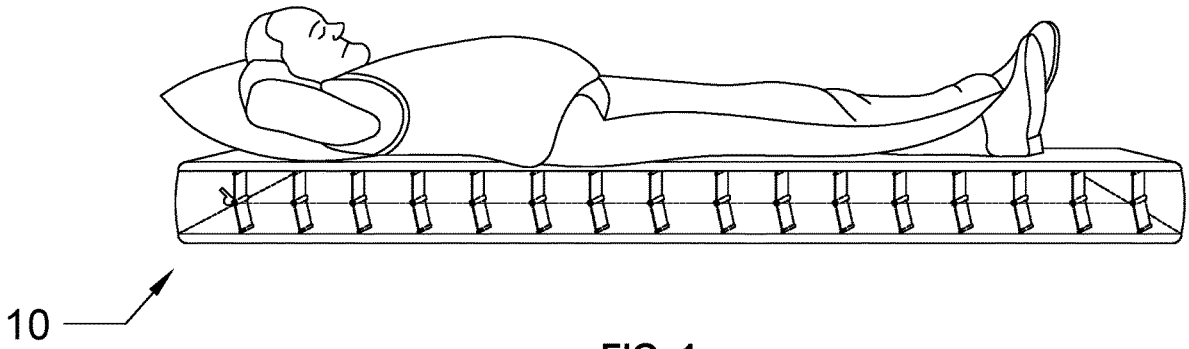

With the above and other related objects in view, the invention consists in the details of construction and combination of parts as will be more fully understood from the following description, when read in conjunction with the accompanying drawings in which:

FIG. 1 represents an operational view of an exemplary embodiment of the present invention 10.

Figure 2:
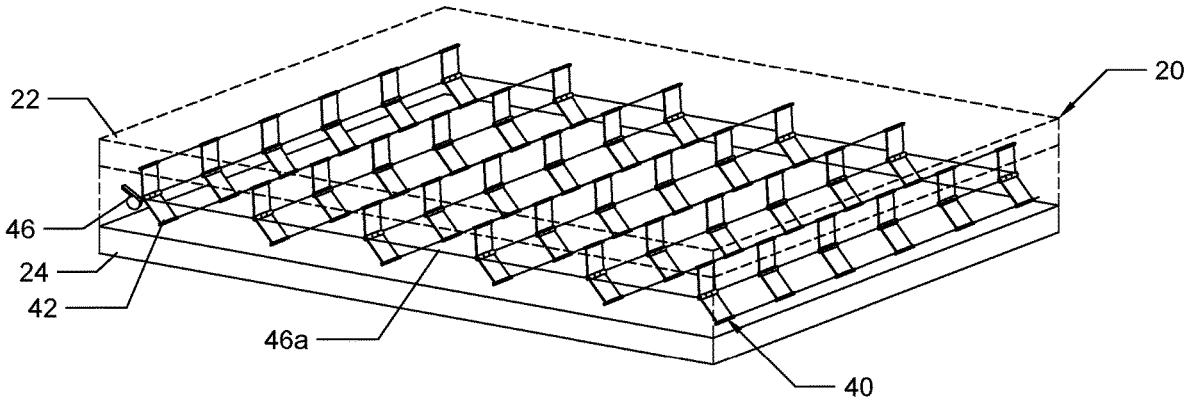

FIG. 2 shows an isometric see-through view of the mattress assembly 20, wherein the spring assembly 40 is placed between the top layer 22 and the bottom layer 24 along the area thereof while extended.

Figure 3:
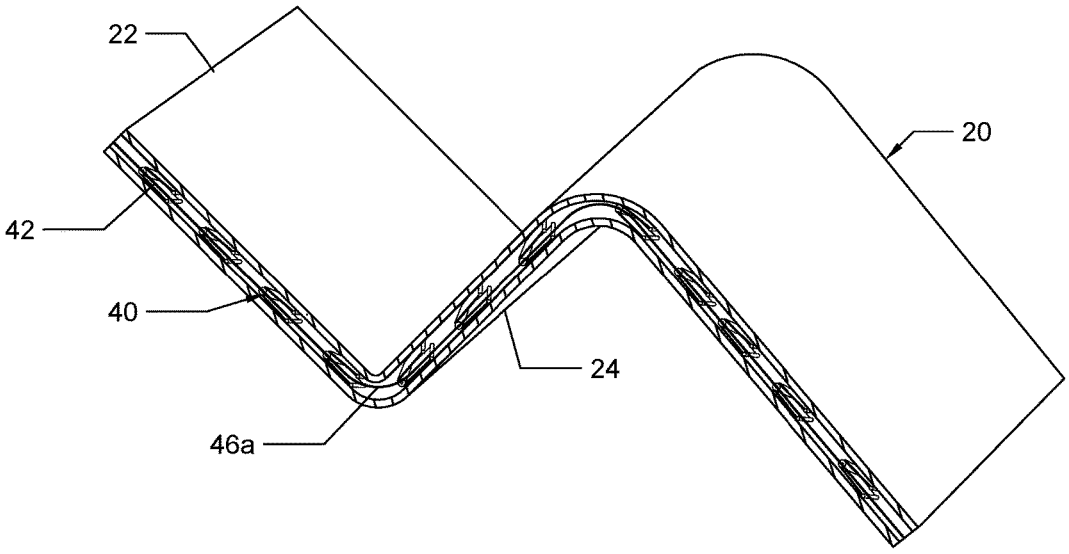

FIG. 3 illustrates an isometric view of the present invention 10 while the plurality of collapsible members 42 is actuated by means of the lever 46, thereby the mattress assembly 20 may be adapted into a folded configuration.

Figure 4:
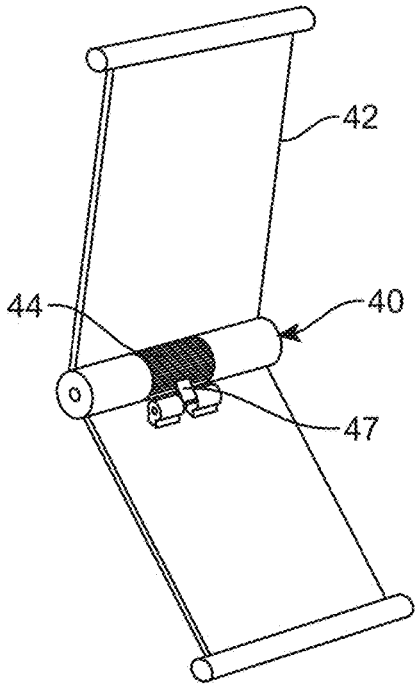

FIG. 4 is a representation of an isometric view of a collapsible member of the plurality of collapsible members 42.

Figure 5:
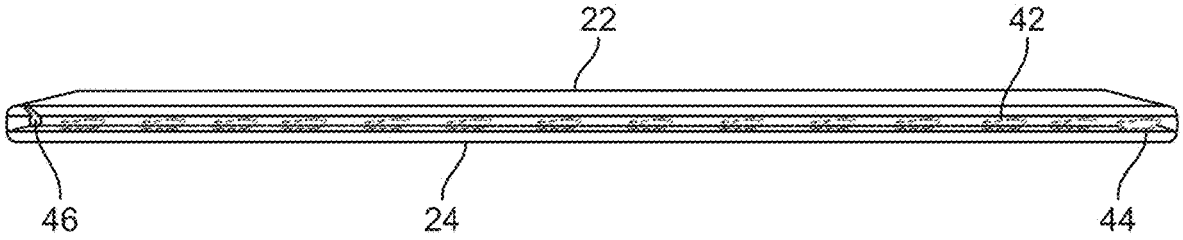

FIG. 5 depicts a front view of the present invention 10, wherein the plurality of collapsible members 42 is in a collapsed configuration, providing a thin and pliable mattress assembly 20.

V. DETAILED DESCRIPTION OF THE EMBODIMENTS OF THE INVENTION

Referring now to the drawings, where the present invention is generally referred to with numeral 10, it can be observed that it basically includes mattress assembly 20 and a spring assembly 40. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Mattress assembly 20 including a top layer 22 and a bottom layer 24. In an exemplary embodiment, the top layer 22 may be a rectangular pad that is configured for supporting a lying user. Nonetheless, it should be considered that a square shape or any other suitable shape is configured for supporting a lying user or a plurality of users. In a preferred embodiment, the top layer 22 may be made of polyurethane foam, viscoelastic foam, cotton fiber, latex foam, or any other suitable variation thereof. It should be considered that a multi-layer of said materials may form the top layer 22, wherein said top layer 22 may include an upholstery layer to include at least one of the materials that may conform with the material that top layer 22 is made of. In a preferred embodiment, the top layer 22 may be pliable, thereby the top layer 22 may be folded or rolled to reduce the size thereof to be transported and/or stored. As shown in FIG. 3. In a suitable embodiment bottom layer 24 may be symmetrical with respect to top layer 22, wherein bottom layer 24 may be made of at least one of the materials that conforms the top layer 22, nevertheless, it should be considered that the bottom layer 24 may be made of different material than top layer 22, wherein said materials may be pliable, therefore, bottom layer 24 may be folded and/or rolled in conjunction with top layer 22. As best illustrated in FIG. 3. It should be considered that top layer 2 and bottom layer 24 may have a separation therebetween, wherein top layer 22 and bottom layer 24 are attached by means of a spring assembly 40. As FIG. 2 illustrates. In a suitable variation of the mattress assembly 20, the top layer 22 and the bottom layer 24 may be included inside of an upholstery, wherein said upholstery with the top layer 22, the bottom layer 24 and the spring assembly 40 may simulate a mattress well known in the art.

Spring assembly 40 includes a plurality of collapsible members 42 a plurality of torsion spring hinges 44, a lever 46 and wire **46*a*, wherein each collapsible member of the plurality of collapsible members 42 include a torsion spring hinge of the plurality of torsion spring hinges 44. In an exemplary embodiment, the plurality of collapsible members 42 are placed along the area of an internal surface of the top layer 22 and the bottom layer 24. As FIG. 2 represents. In a suitable embodiment, the plurality of collapsible members 42 may be comprised of a top plate and a bottom plate with a joint wire on each plate, as FIG. 4 illustrates, thereby the wire 46*a* may join every row and column of the plurality of collapsible members 42, as FIG. 2 represents. The plurality of collapsible members 42 may be attached to the top layer 22 and the bottom layer 24, thereby said plurality of collapsible members 42 are configured to support and absorb the weight of a user when laid on the top layer 22 or bottom layer 24. In a preferred embodiment, the plurality of collapsible members 42 may include knuckles, wherein the knuckles may conform tubular shape parallel placed at the bottom edge of the top portion of the plurality of collapsible members 42 and a top edge of the bottom portion of the plurality of collapsible members 42, wherein the position of the knuckles match therebetween allowing the plurality of torsion spring hinges 44 to pass through the tubular shape of the knuckles, thereby the top portion and the bottom portion of the plurality of collapsible members 42 permits a limited angle of rotation therebetween with respect to the longitudinal axis of the pin. In one embodiment, each collapsible member of the plurality of collapsible members 42 may include a torsion spring hinge of the plurality of torsion spring hinges 44, wherein the plurality of torsion spring hinges 44 may be a collapsible spring-loaded mechanism that allows said plurality of collapsible members 42 to absorb a load and further collapse when the lever 46** is actuated.

Referring to FIG. 1 a user may lie on the top layer 22 and the spring assembly 20 may collapse in a predetermined position to support and conform with the shape of the user. It should be considered that the spring assembly 40 may include a ratchet mechanism 47 on each collapsible member of the plurality of the collapsible members or a partiality thereof, wherein the ratchet mechanism 47 allows an unidirectional rotary motion, thereby the spring assembly 20 may maintain a collapsed configuration when the ratchet mechanism 47 is actuated, preventing the plurality of collapsible members 44 to return to its original position, thereby the present invention 10 may reduce its size, allowing the mattress assembly to be folded or rolled to be transported and/or stored As shown in FIG. 3. It should be considered that the plurality of collapsible members 42 may return to its original or natural position when the ratchet mechanism 47 is deactivated by means of the lever 46, a button, or any other suitable mechanism.

Referring to the figures, and more particularly to FIG. 5, the lever 46 may be actuated to collapse the plurality of collapsible members 42 to reduce the size of the mattress assembly 20, wherein the plurality of collapsible members is operatively connected by means of the wire 46*a*, thereby the user may actuate the lever 46 placed on a lateral side of the mattress assembly 20. It should be considered that the mattress assembly 20 is capable of being folded when collapsed for transporting or storing. As FIG. 3 depicts. In a suitable embodiment, the user may revert the collapsed configuration of the plurality of collapsible members 42 by actuating the lever 46 in an opposite direction, thereby the mechanism of the plurality of torsion spring hinges 44 may be actuated by means of the wire 46*a* allowing the mattress assembly to rest in a non-collapsed configuration. As FIG. 2 represents. It should be considered that the wire 44*a* may be made of a rigid material such as metal wire, nevertheless, the wire 44*a* may be made of a plastic material, a tubing material or any other suitable material that allows con connect the plurality of collapsible members 42 and transmit the torsion force applied by the lever to achieve said collapsible configuration.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A portable spring mattress, consisting of:

a mattress assembly including a top layer and a bottom layer, wherein said top layer is a rectangular pad configured to support a weight of a user when laid over said top layer, said bottom layer is symmetrical with respect to said top layer, said top layer and said bottom layer have a separation therebetween, wherein said top layer and said bottom layer are attached therebetween by means of a plurality of collapsible members, wherein said top layer and said bottom layer are made of a pliable foam, wherein said foam is configured to be folded and/or rolled to be transported or stored; and a spring assembly having said plurality of collapsible members, a plurality of torsion spring hinges, a lever, and a wire, wherein said plurality of collapsible members are placed along an internal area of said top layer and said bottom layer, wherein each collapsible member of said plurality of collapsible members have a top plate and a bottom plate, said plurality of torsion spring hinges are included on said plurality of collapsible members, allowing said plurality of collapsible members to be collapsed and return to its original position when said lever is actuated, said lever is operatively connected to said plurality of torsion spring hinges by means of said wire, wherein said plurality of collapsible members are operatively connected by means of said wire, wherein said plurality of collapsible members are placed in rows and columns, said top plate and said bottom plate include knuckles that matches or connects therebetween, wherein said knuckles with a tubular shape allows a torsion spring hinge of the plurality of torsion spring hinges to be placed therein, said plurality of collapsible members is capable of being rotated in a predetermined angle of rotation, said plurality of torsion spring hinges are capable of rest in a collapsed configuration and return to a non-collapsed configuration when actuating said lever, said plurality of collapsible members includes a ratchet mechanism that allows said top plate and said bottom plate to be folded to reduce the size of the mattress assembly.

* * * * *